US006327783B1

(12) United States Patent
Ming

(10) Patent No.: US 6,327,783 B1
(45) Date of Patent: Dec. 11, 2001

(54) ROTATING AND LOCATING STRUCTURES OF PROTECTIVE SHIELD OF ROUND KNIFE

(76) Inventor: Chen Shan Ming, 1-6, Lane 2 Feng Tse Village, Pu Yen Hsiang, Changhau Hsien (TW)

( * ) Notice: Subject to any disclaimer, the term of this patent is extended or adjusted under 35 U.S.C. 154(b) by 0 days.

(21) Appl. No.: 09/528,851

(22) Filed: Mar. 20, 2000

(51) Int. Cl.[7] ..... B26B 25/00
(52) U.S. Cl. ..... 30/292; 30/286; 30/319
(58) Field of Search ..... 30/151, 286, 292, 30/319, 320; 63/478

(56) References Cited

U.S. PATENT DOCUMENTS

| | | | | |
|---|---|---|---|---|
| Re. 32,501 | * | 9/1987 | Okada | 30/292 |
| 1,358,973 | * | 11/1920 | Minarcik | 30/286 |
| 2,695,447 | * | 11/1954 | Maynard | 30/286 |
| 3,802,080 | * | 4/1974 | Peter | 30/292 |
| 4,020,550 | * | 5/1977 | Okada | 30/292 |
| 4,301,594 | * | 11/1981 | Okada | 30/292 |
| 4,601,103 | * | 7/1986 | Sugiyama | 30/292 |
| 5,101,564 | * | 4/1992 | Melter | 30/292 |
| 5,144,749 | * | 9/1992 | Chen | 30/319 |
| 5,299,355 | * | 4/1994 | Boda et al. | 30/292 |
| 5,355,588 | * | 10/1994 | Brandenburg, Jr. et al. | 30/319 |
| 5,711,077 | * | 1/1998 | Schulz et al. | 30/319 |
| 5,765,289 | * | 6/1998 | Schulz et al. | 30/319 |
| 6,044,565 | * | 4/2000 | Arend et al. | 30/319 |
| 6,094,824 | * | 8/2000 | Takeshita | 30/292 |

* cited by examiner

*Primary Examiner*—Kenneth E. Peterson
*Assistant Examiner*—Stephen Choi
(74) *Attorney, Agent, or Firm*—Harrison & Egbert

(57) ABSTRACT

A round knife including a handle which is provided in a head end thereof with a slot for receiving pivotally a round knife blade and a support frame. The slot is provided with a protective groove for retaining and locating the support frame. When the support frame is securely engaged with the protective groove, the round knife blade is concealed securely by a protective shield of the support frame. The support frame can be actuated by an actuation piece to rotate so as to expose the round knife blade to execute the cutting operation.

2 Claims, 12 Drawing Sheets

ROTATING AND LOCATING STRUCTURES OF PROTECTIVE SHIELD OF ROUND KNIFE

FIELD OF THE INVENTION

The present invention relates generally to a protective shield of a round knife, and more particularly to a means for rotating and locating the protective shield of the round knife.

BACKGROUND ART

As shown in FIGS. 1 and 2, a round knife 10 of the prior art comprises a handle 11 which is provided at the front end thereof with a rotatable protective shield 12 covering a round blade 13. The protective shield 12 is rotated to expose the round blade 13 or to shield the round blade 13.

The round knife 10 of the prior art described above is defective in design because the protective shield 12 can not be easily turned with a finger in spite of the protective shield 12 being provided in the outer side thereof with two protrusions 121 and 122 which are too small in size to stop the finger. In addition, the round blade 13 can be accidentally exposed at such time when the protective shield 12 is exerted on by an external force. In other words, the protective shield 12 of the prior art round knife 10 is a safety hazard.

SUMMARY OF THE INVENTION

The primary objective of the present invention is to provide a protective shield of a round knife, which is free from the drawbacks or the protective shield of the prior art round knife described above.

In keeping with the principle of the present invention, the foregoing objective of the present invention is attained by a round knife comprising a handle with a head portion which is provided with a slot for receiving a round knife blade and a support frame. The support frame is provided with an arcuate protective shield. The round knife blade and the support frame are pivoted in the slot such that the rotating and the locating of the round knife blade are controlled by the support frame.

The foregoing objective and features of the present invention will be more readily understood upon a thoughtful deliberation of the following detailed description of a preferred embodiment of the present invention with reference to the accompanying drawings.

DETAILED DESCRIPTION OF THE INVENTION

Figure 1:
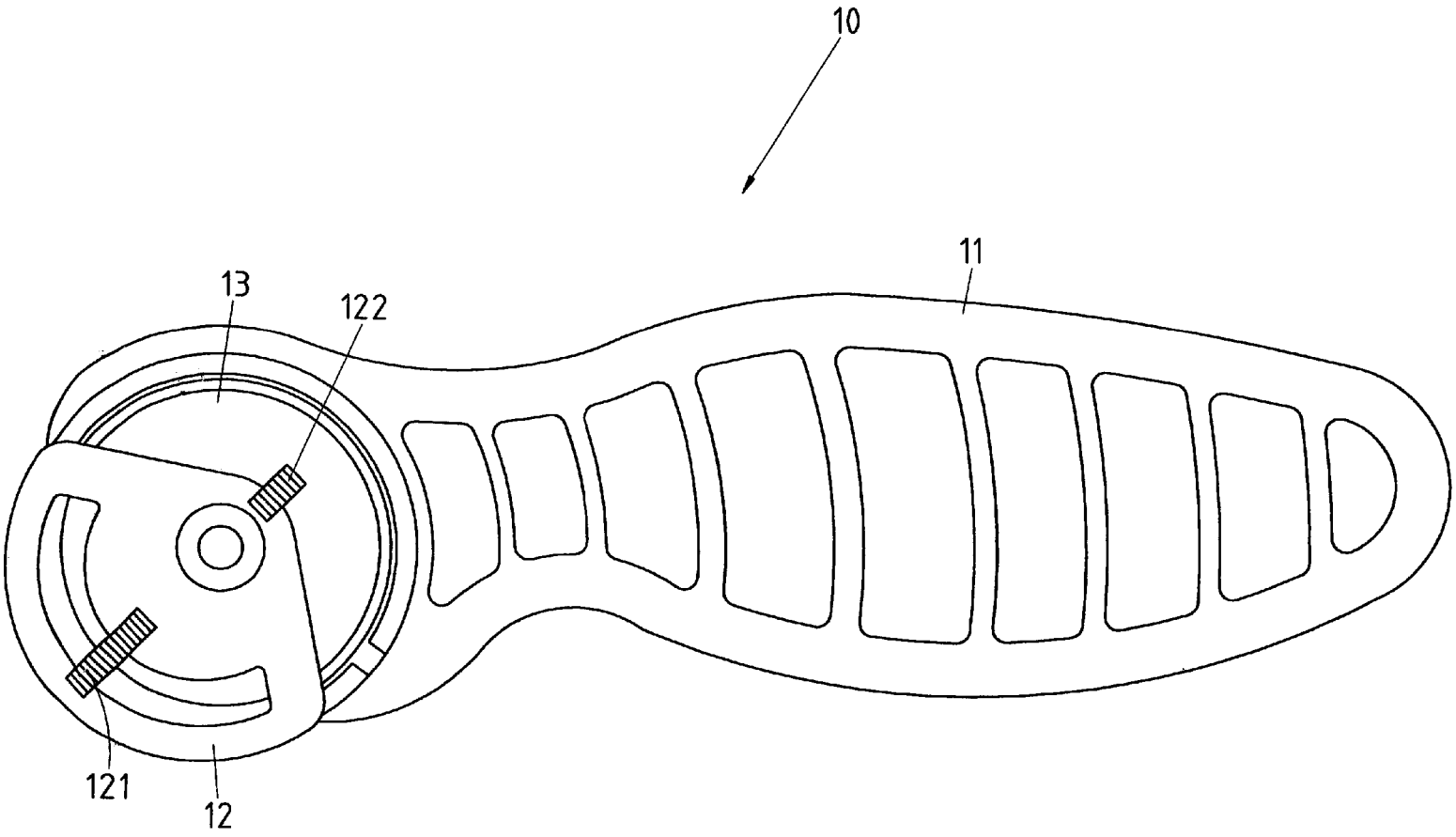
FIG.1 PRIOR ART
FIG. 1 shows a plan view of a round knife or the prior art.
Figure 2:
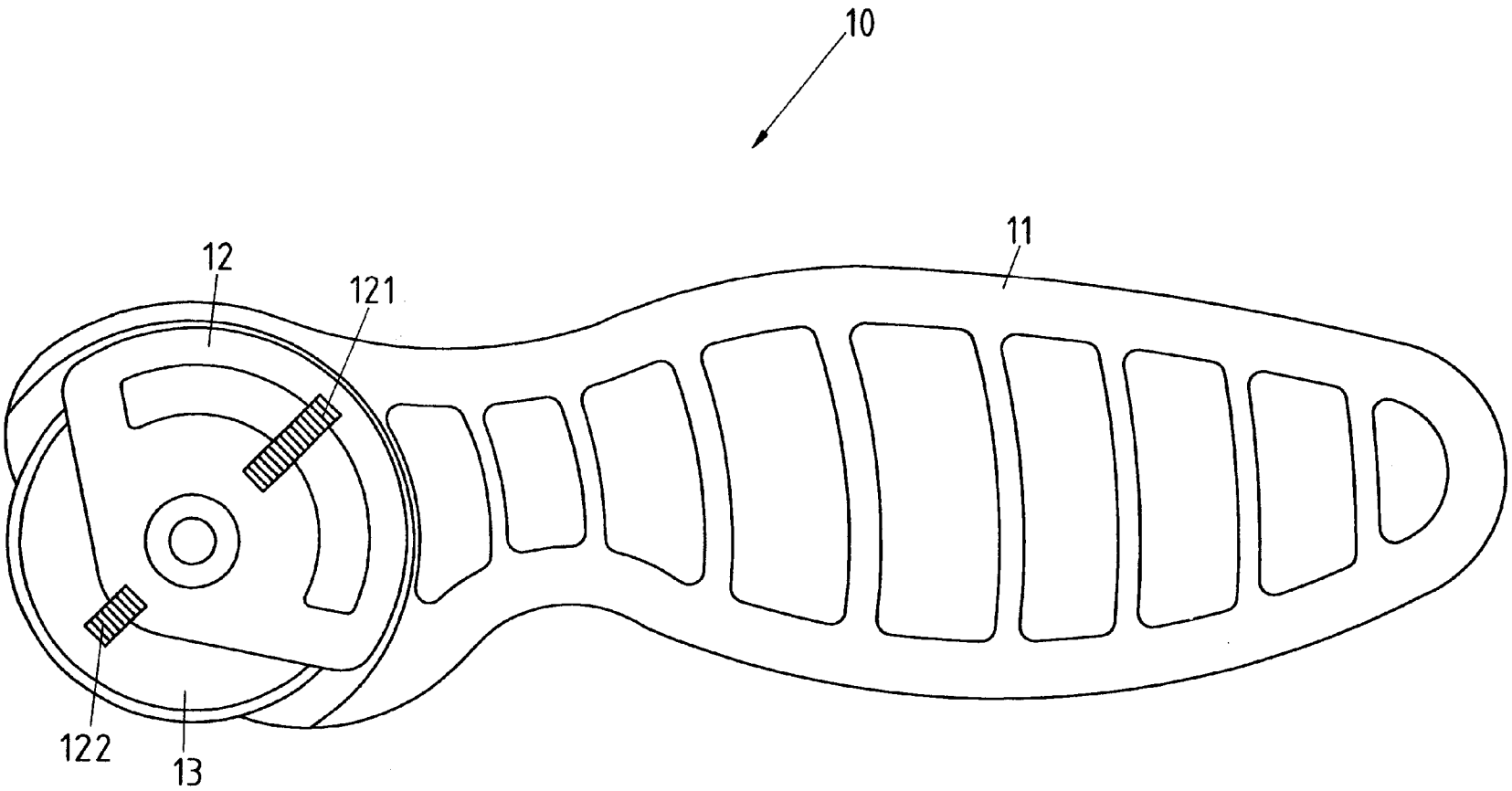
FIG. 2 PRIOR ART
FIG. 2 shows another plan view of the round knife of the prior art.
Figure 3:
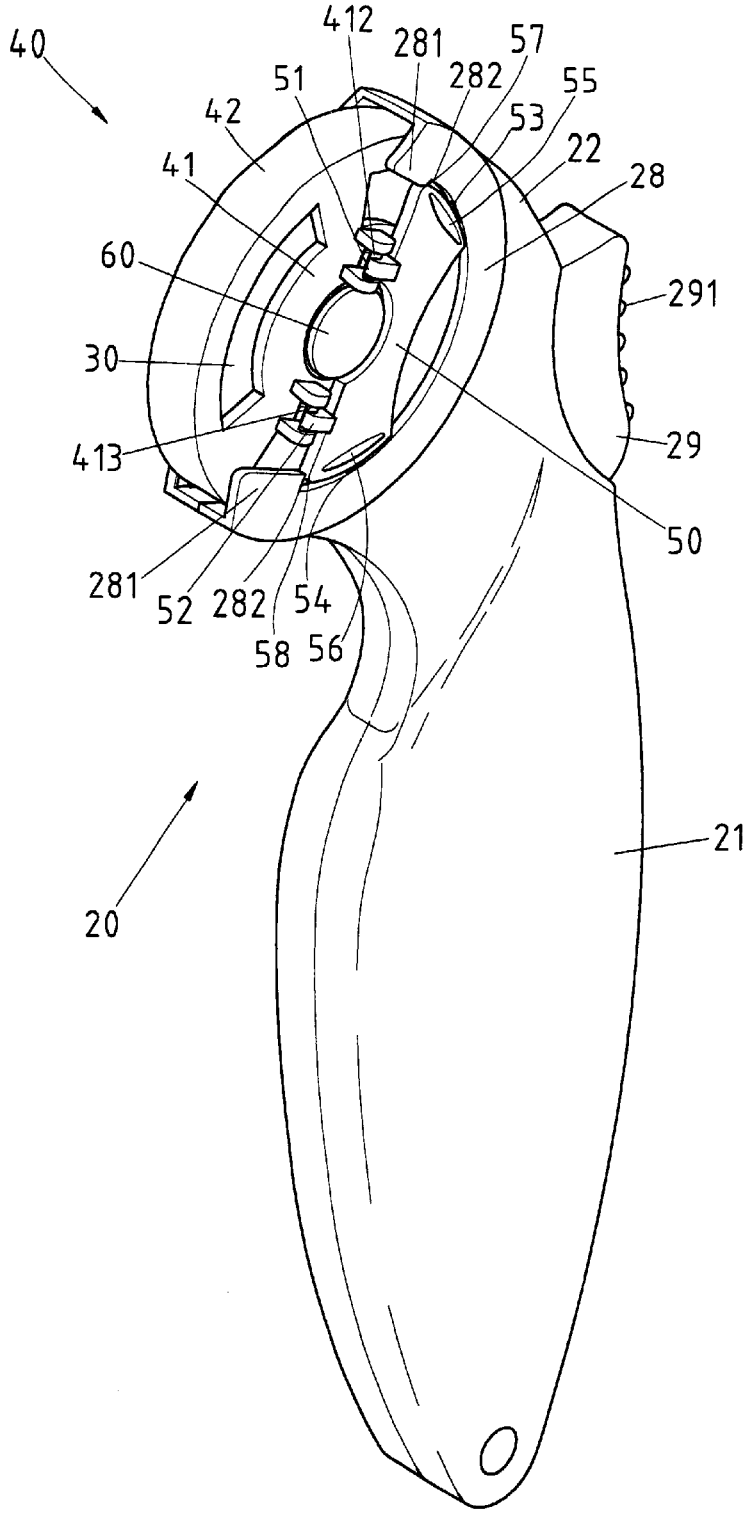
FIG. 3 shows a perspective view of a round knife of the preferred embodiment of the present invention.
Figure 4:
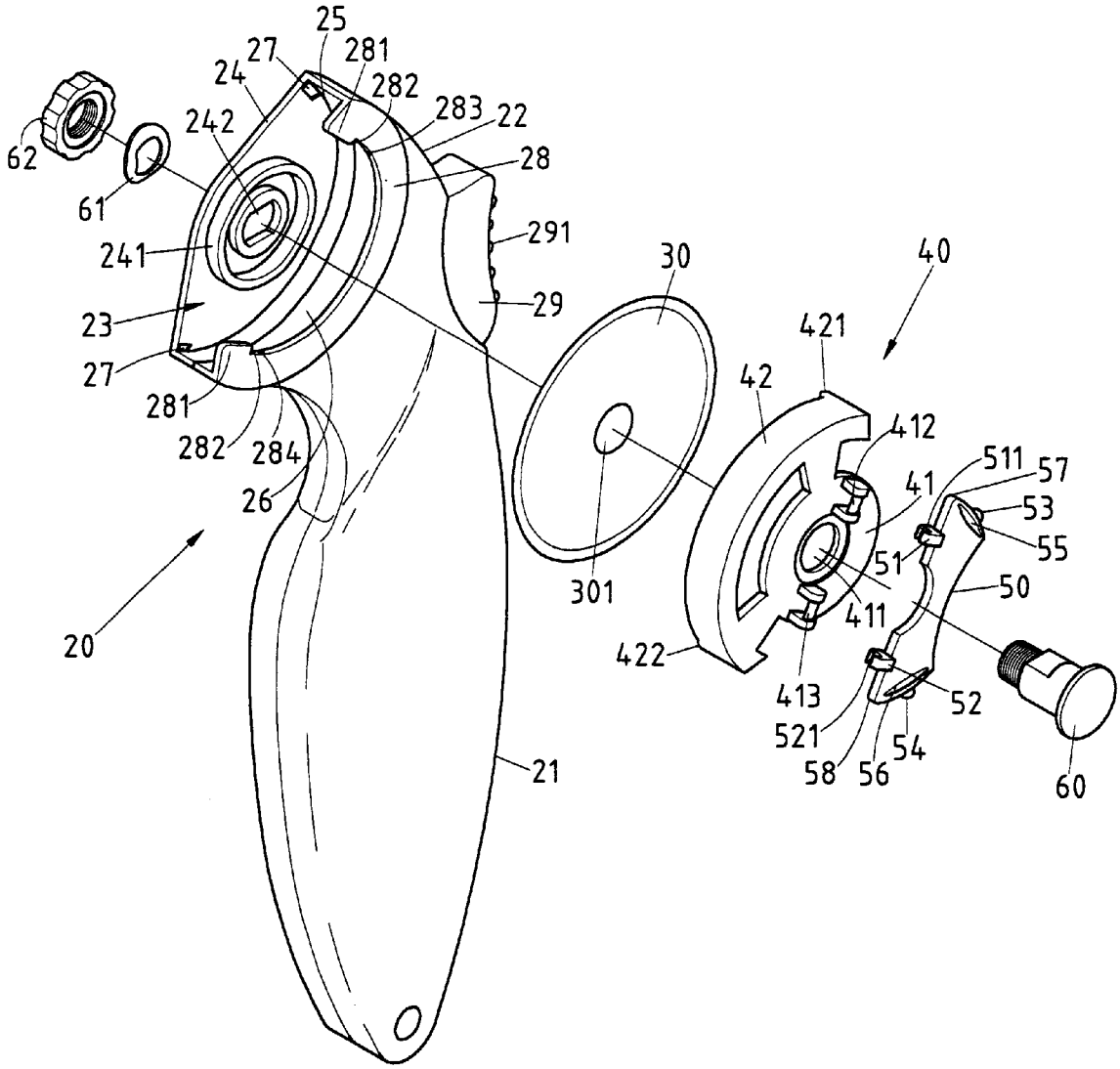
FIG. 4 shows an exploded view of the round knife of the preferred embodiment of the present invention.
Figure 5:
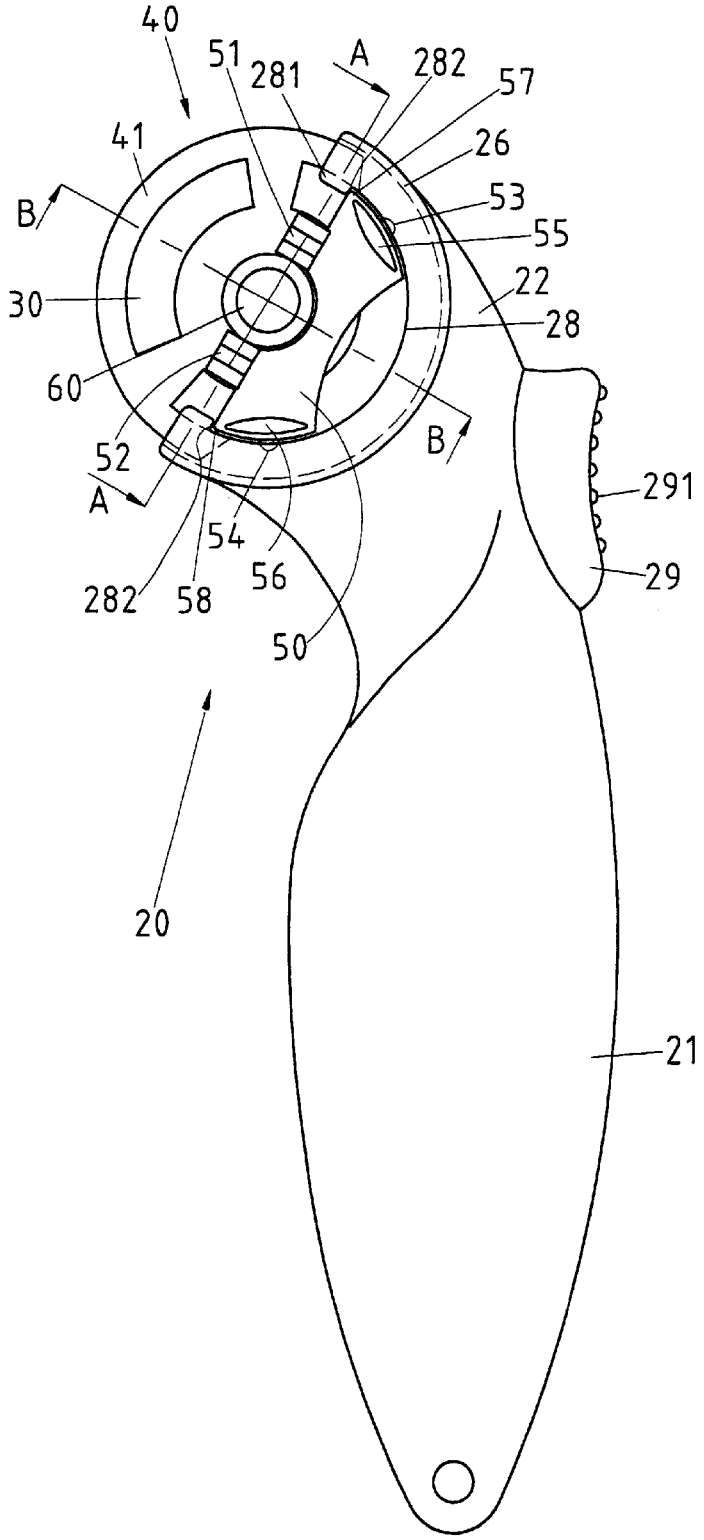
FIG. 5 shows a schematic plan view of the round knife of the preferred embodiment of the present invention.
Figure 6:
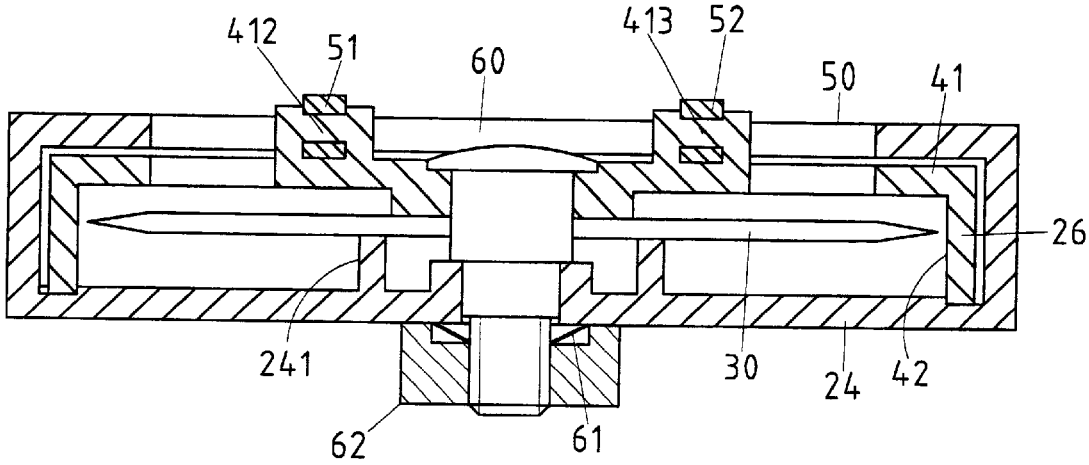
FIG. 6 shows a sectional view of a portion taken along the direction indicated by a line A—A as shown in FIG. 4.
Figure 7:
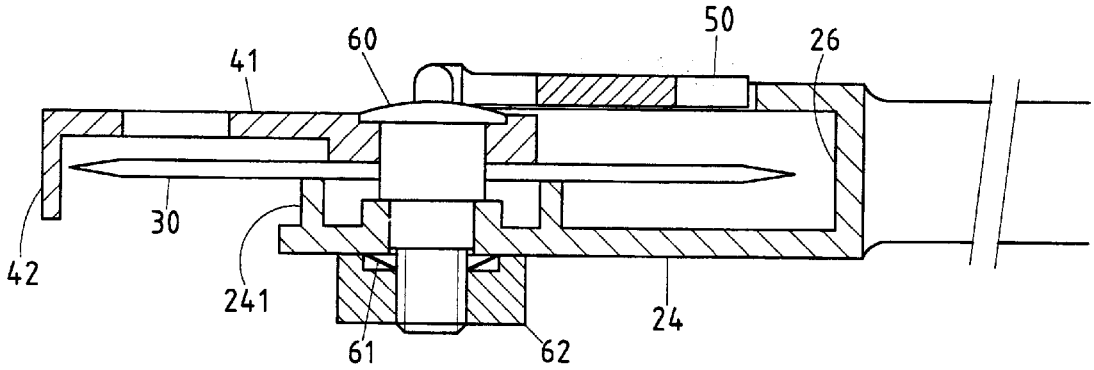
FIG. 7 shows a sectional view of a portion taken along the direction indicated by a line B—B as shown in FIG. 4.
Figure 8:
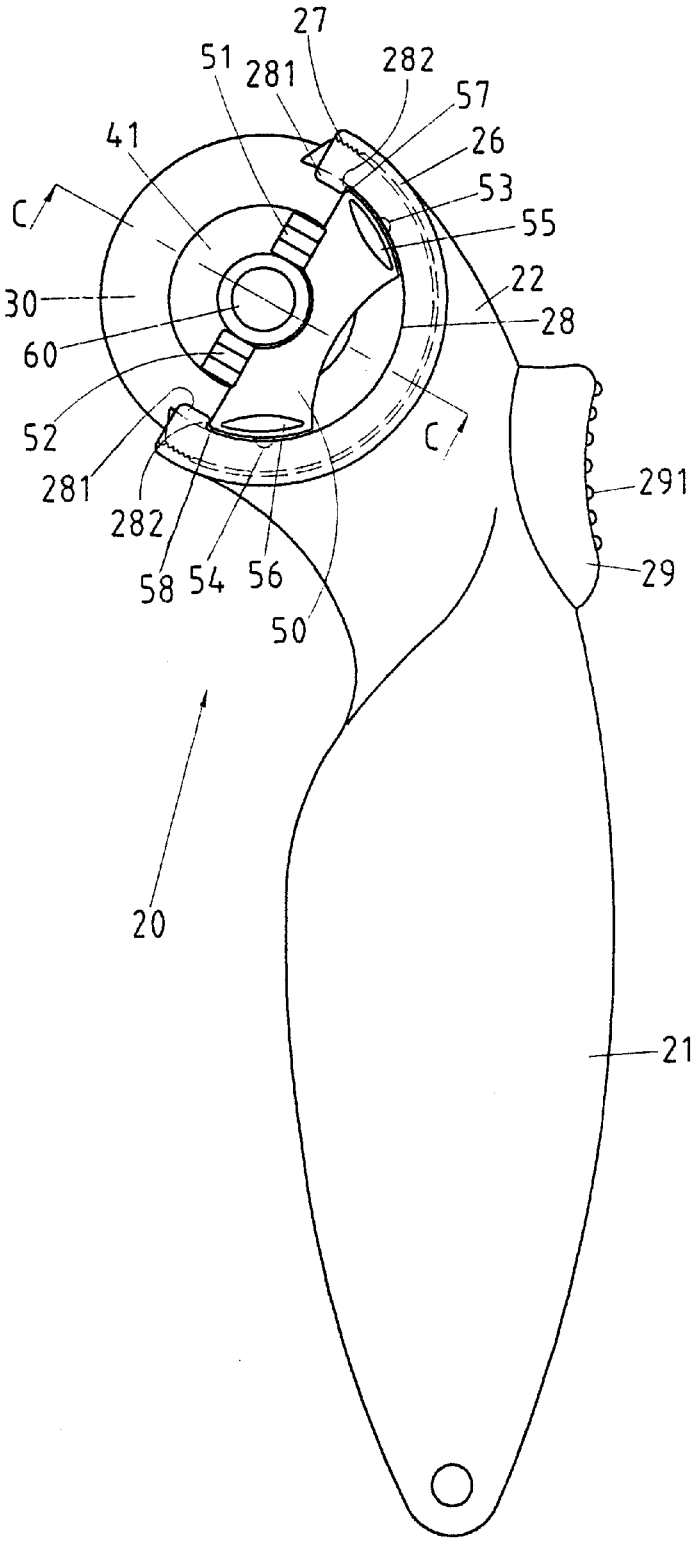
FIG. 8 is a schematic plan view of the preferred embodiment of the present invention showing that the round knife blade is exposed.
Figure 9:
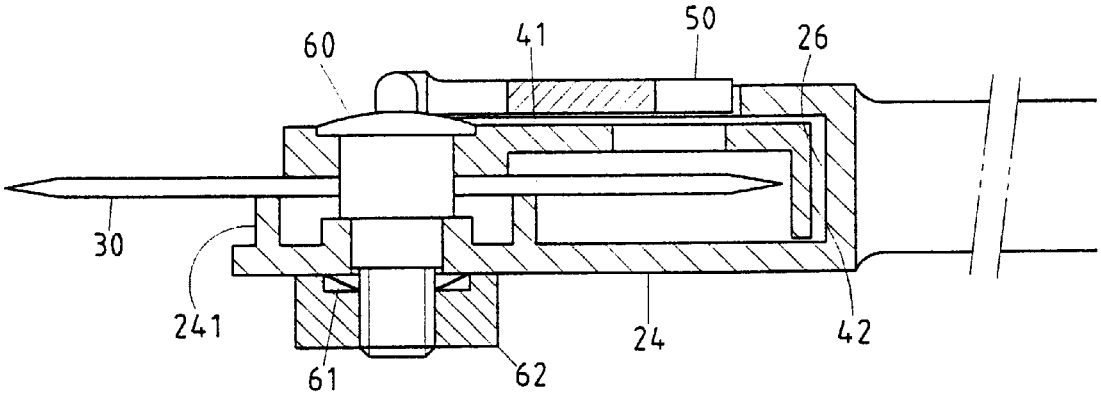
FIG. 9 shows a sectional view of a portion taken along the direction indicated by a line C—C as shown in FIG. 7.
Figure 10:
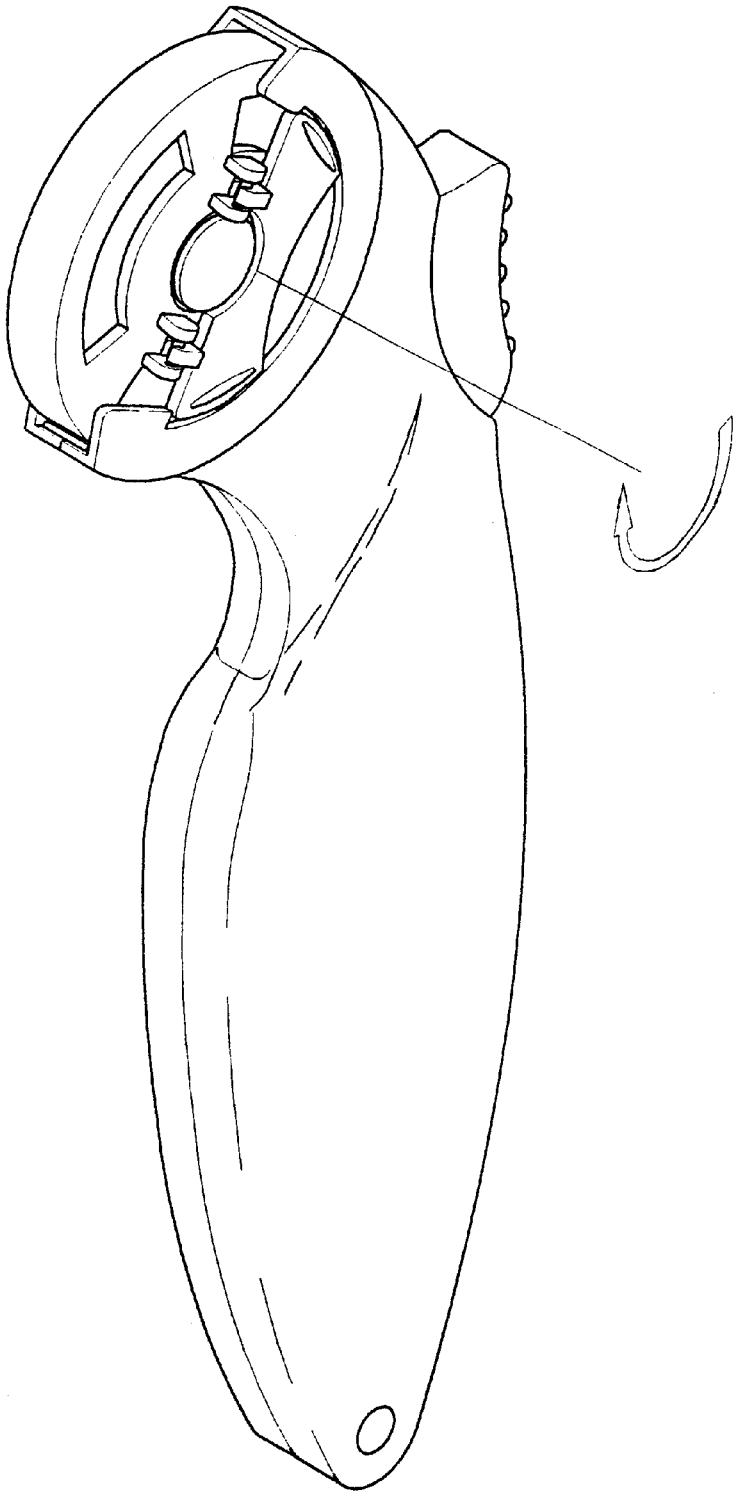
FIG. 10 is a schematic view of the preferred embodiment of the present invention showing that the round knife blade is concealed.
Figure 11:
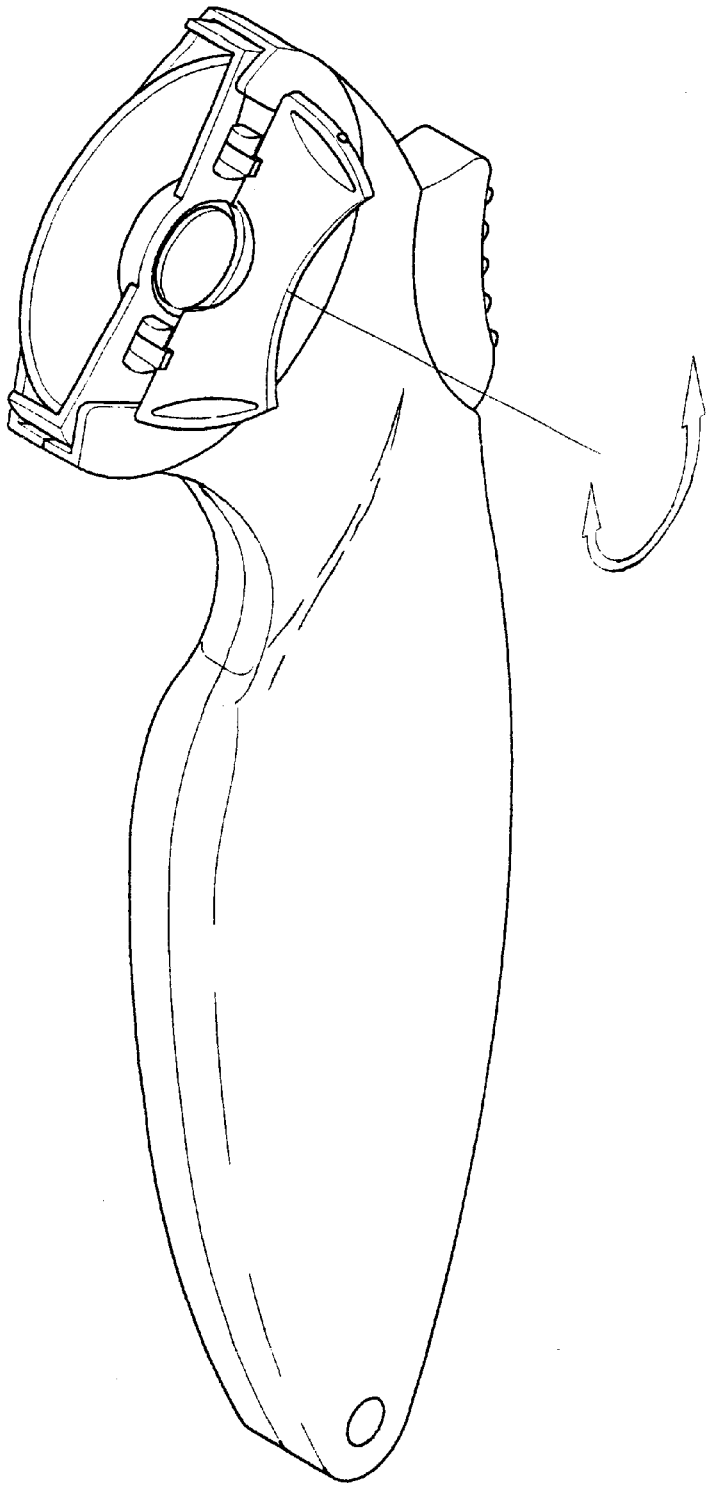
FIG. 11 shows a schematic view showing that the support frame of the present invention is rotated by the actuation piece.
Figure 12:
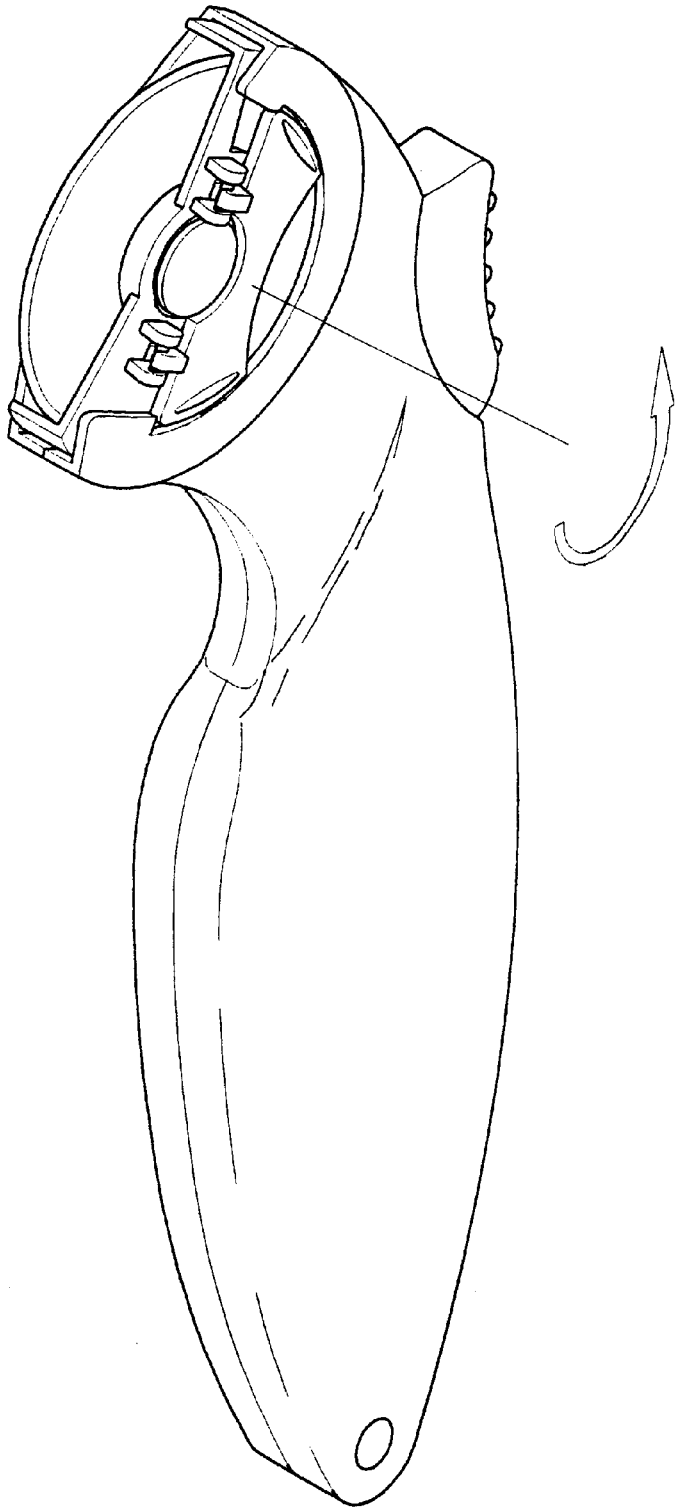
FIG. 12 shows a schematic view of the round knife blade of the present invention being exposed.

As shown in FIGS. 3–6, a round knife 20 embodied in the present invention comprises a handle 21, a round knife blade 30, a support frame 40, an actuation piece 50, and a bolt 60.

The handle 21 has a head portion 22 which is located at one end thereof and is provided with a slotted area 23 having a seat plate 24. The slot 23 is provided in the inner side thereof with a semicircular protective groove 25, and in the opposite ends of the inner side 26 thereof with a retaining tooth 27. The inner side 26 is further provided in one side thereof with a upturned side 28 opposite in location to the seat plate 24. The upturned side 28 is provided at two ends thereof with an enlarged portion 281, an arresting shoulder 282, and two retaining slots 283 and 284. The seat plate 24 is provided in the center of the inner side 26 thereof with a protruded ring 241 which is located in the slotted area 23 and is provided with a bolt hole 242.

The round knife blade 30 is disposed in the slotted area of the handle 21 such that the round knife blade 30 is attached to the protruded ring 241, and that the round knife blade 30 is spaced from and parallel to the seat plate 24. The round knife blade 30 is provided in the center thereof with a pivoting hole 301 in axial alignment with the bolt hole 242 of the seat plate 24.

The support frame 40 is formed of a face plate 41 and a protective shield 42 of a semicircular construction. The face plate 41 is provided in the center thereof with a through hole 411 and two pivot pins 412 and 413. The protective shield 42 is connected to the support frame 40 and is provided at two ends of the outer wall thereof with racks 421 and 422. The support frame 40 is disposed in the slotted area 23 of the handle 21 such that the round knife blade 30 is covered by the support frame 40. As the support frame 40 is rotated, the protective shield 42 is moved into the protective groove 25 such that the two racks 421 and 422 of the protective shield 42 are engaged with the retaining teeth 27 at the opposite ends of the protective groove 25. The through hole 411 of the support frame 40 is axially aligned with the pivoting hole 301, of the round knife blade 30 and the bolt hole 242 of the seat plate 24.

The actuation piece 50 is provided with two retaining blocks 51 and 52 with respective two retaining holes 511 and 521. The actuation piece 50 is engaged with the support frame 40 such that the pivot pins 412 and 413 of the face plate 41 of the support frame 40 are engaged respectively with the retaining holes 511 and 521 of the respective retaining blocks 51 and 52 of the actuation piece 50, and that the actuation piece 50 can be rotated 180 degrees in relation to the face plate 41 of the support frame 40. The actuation piece 50 is further provided with two elastic retaining protrusions 53 and 54, two through holes 55 and 56, and two angled corners 57 and 58.

The bolt 60 is used to fasten pivotally the round knife blade 30 and the support frame 40 to the handle 21 in conjunction with an elastic washer 61 and a nut 62. The bolt 60 is received in the through hole 411 or the face plate 41 of the support frame 40, the pivoting hole 301 of the round knife blade 30, and the bolt hole 242 of the seat plate 24 of the handle 21.

The head portion 22 of the handle 21 is provided in the outer wall thereof with a skidproof block 29 having thereon a plurality of skidproof fine grooves 291.

As illustrated in FIGS. 7–12, when the round knife blade 30 is concealed by the support frame 40, the two racks 421 and 422 of the protective shield 42 of the support frame 40 are securely engaged with the two retaining teeth 27 of the protective groove 25. In the meantime, the actuation piece 50 is securely located on the face plate 41 of the support frame 40 such that the two retaining protrusions 53 and 54 are securely retained in the retaining slots 283 and 284 of the upturned side 28 of the handle 21, and that the two corners 57 and 58 of the actuation piece 50 are stopped by the two enlarged portions 281 and the arresting side 282. As a result, the support frame 40 is confined by the actuation piece 50 such that the support frame 40 can not be accidentally rotated to expose the round knife blade 30.

Before the support frame 40 is rotated to expose the round knife blade 30, the actuation piece 50 must be raised upright at an angle of 90 degrees such that the two retaining protrusions 53 and 54 of the actuation piece 50 are disengaged from the retaining slots 283 and 284 of the upturned side 28 of the handle 21, and that the two corners 57 and 58 of the actuation piece 50 are moved away from the arresting side 282. The support frame 40 is thus no longer confined by the actuation piece 50 such that the support frame 40 can be rotated to expose the round knife blade 30, and that the protective shield 42 is moved into the protective groove 25. In the meantime, the protective shield 42 is securely located by the two racks 421 and 422 which are engaged with the two retaining teeth 27 of the protective groove 25. The actuation piece 50 is pressed toward the upturned side 28 at an angle of 90 degrees such that the two retaining protrusions 53 and 54 or the actuation piece 50 are retained respectively in the retaining slots 283 and 284 of the upturned side 28, and that the two corners 57 and 58 of the actuation piece 50 are arrested by the arresting side 282. As a result, the support frame 40 is securely located while the round knife blade 30 is in operation.

Figure 13:
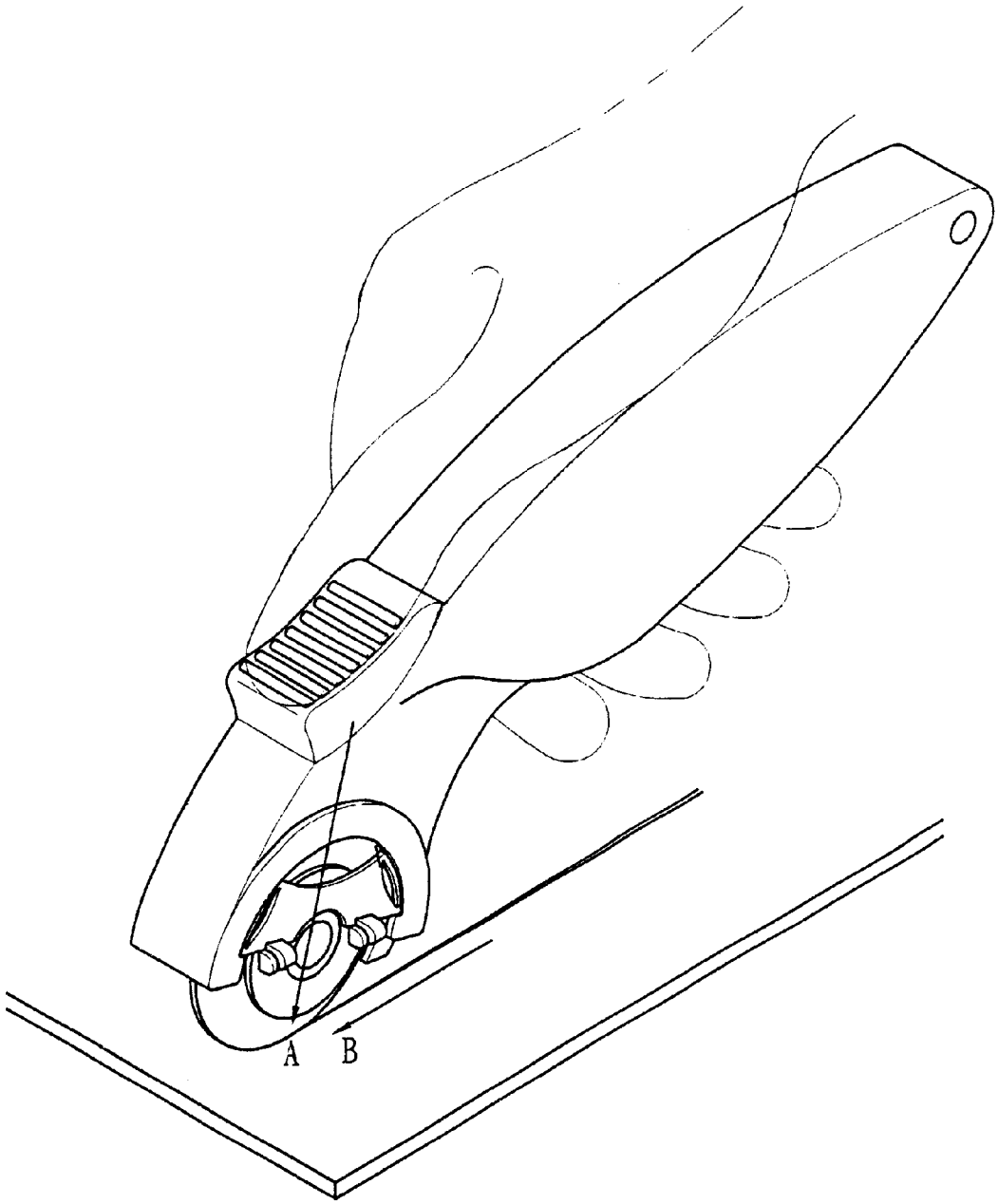
FIG. 13 shows a schematic view of the present invention in operation.

As illustrated in FIG. 13, when the handle 21 is held in one hand of a user of the round knife 20 of the present invention, the thumb is in contact with the skidproof block 29 of the head portion 22 of the handle 21 such that the round knife blade 30 is exerted on by the downward application force "A" of the thumb and the pushing force "B" of the hand. In light of the design of the present invention conforming to the mechanics of the human body, the round knife blade 30 of the present invention can be easily operated to cut a workpiece.

The preferred embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A knife apparatus comprising:

a handle having a head portion, said head portion having a slotted area and a seat plate defining a wall of said slotted area, said slotted area having a semicircular protective groove therein with two retaining teeth formed at respective opposite ends thereof, said slotted area having an upturned side opposite to said seat plate, said upturned side having two enlarged portions at respective opposite ends thereof, said upturned side having an arresting shoulder formed adjacent at least one of said two enlarged portions, said upturned side having two retaining slots formed therein, said seat plate having a bolt hole formed therein;

a round knife blade rotatably mounted within said slotted area of said head portion of said handle such that said round knife blade is spaced from and in parallel relation to said seat plate, said round knife blade having a hole in a center thereof, said hole of said round knife blade being axially aligned with said bolt hole of said seat plate;

a support frame formed of a face plate with a protective shield extending transversely therefrom, said face plate having a through hole formed in a center thereof, said face plate having a pair of pivot pins formed thereon, said protective shield having opposite ends each with a rack formed on an exterior surface thereof, said support frame being rotatably mounted in said slotted area of said head portion such that at least a portion of said round knife blade is covered by said support frame, said support frame being rotatable such that the racks of said protector shield are engaged with respective retaining teeth of said protective groove, said through hole of said face plate being axially aligned with said hole of said round knife blade and said bolt hole of said seat plate;

an actuation piece having two retaining blocks each with a retaining hole, said pair pivot pins of said face plate being respectively engaged with the retaining holes of said retaining blocks of said actuation piece, said actuation piece being pivotable for 180 degrees about said pair of pivot pins of said face plate, said actuation piece having a pair of retaining protrusions formed thereon and a pair of through holes formed therein, said actuation piece having angled corners at opposite ends thereof; and a fastening bolt rotatably mounting said round knife blade and said support frame with said head portion of said handle, said fastening bolt being received in said through hole of said face plate and said hole of said round knife blade and said bolt hole of said seat plate.

2. The apparatus of claim 1, further comprising:

a block having a plurality of grooves formed on an exterior surface thereof, said block being affixed to an outer wall of said head portion of said handle.

* * * * *